United States Patent [19]

McCain

[11] 3,961,451

[45] June 8, 1976

[54] GROUND ANCHOR

[76] Inventor: Jack L. McCain, 2160 Riverview St., Eugene, Oreg. 97201

[22] Filed: Apr. 29, 1974

[21] Appl. No.: 464,941

[52] U.S. Cl. ..... 52/163; 114/208 R

[51] Int. Cl.[2] ..... E02D 5/80

[58] Field of Search ..... 52/146, 148, 158, 159, 52/162, 165, 645, 726, 163, 164, 155, 156; 403/92, 96, 102, 113, 116, 117, 157; 114/206 R, 208 R; 172/372, 739, 740, 748, 699; 294/53.5, 57

[56] References Cited

UNITED STATES PATENTS

| | | | |
|---|---|---|---|
| 815,528 | 3/1906 | Haag | 403/96 |
| 1,711,847 | 5/1929 | Hermanson | 172/372 |
| 2,735,251 | 2/1956 | Dlugosch | 403/157 |
| 2,780,068 | 2/1957 | Grimes | 52/155 |
| 3,306,248 | 2/1967 | Austin | 114/208 R |
| 3,425,174 | 2/1969 | Wood | 52/166 |
| 3,450,088 | 6/1969 | Guier | 114/208 R |
| 3,759,212 | 9/1973 | Cluett | 114/208 |

FOREIGN PATENTS OR APPLICATIONS

| | | | |
|---|---|---|---|
| 4,566 | 3/1895 | United Kingdom | 52/162 |

*Primary Examiner*—Ernest R. Purser
*Assistant Examiner*—William Randolph
*Attorney, Agent, or Firm*—Eugene M. Eckelman

[57] ABSTRACT

A single blade is pivotally attached to a first shank portion in turn pivotally attached to a second shank portion. The pivot connections are arranged and lock pins are provided selectively such that the shank portions can be held in different positions relative to each other and relative to the blade to provide an anchor of varying shapes which has versatility in adapting to various ground conditions and also for compactly folding for storage and shipment.

3 Claims, 5 Drawing Figures

FIG. 1
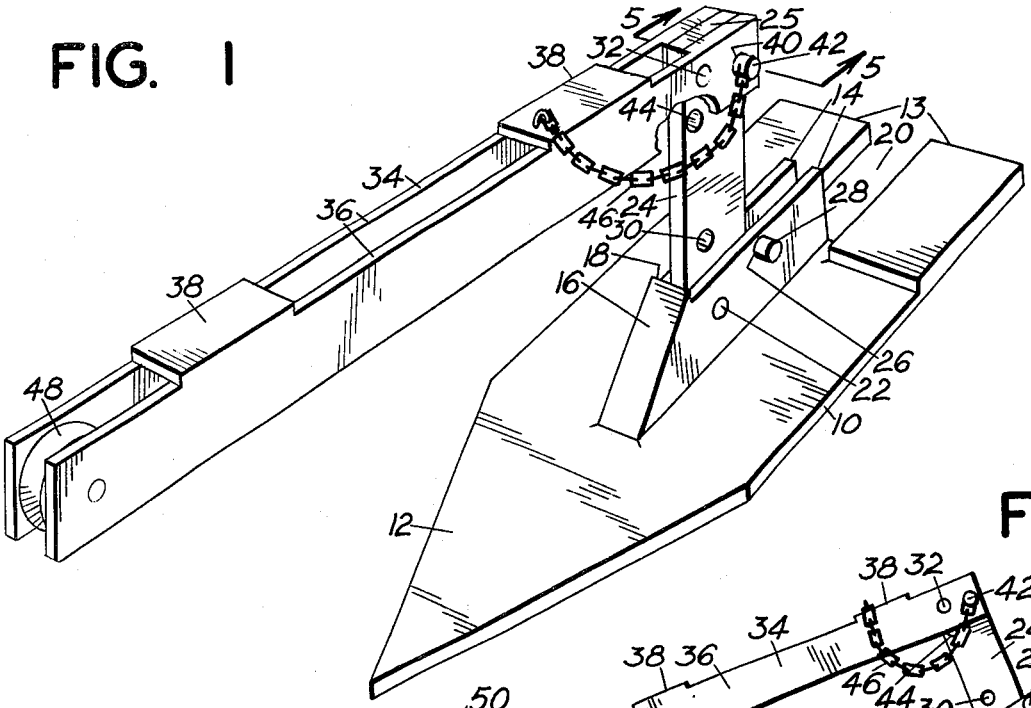
FIG. 2
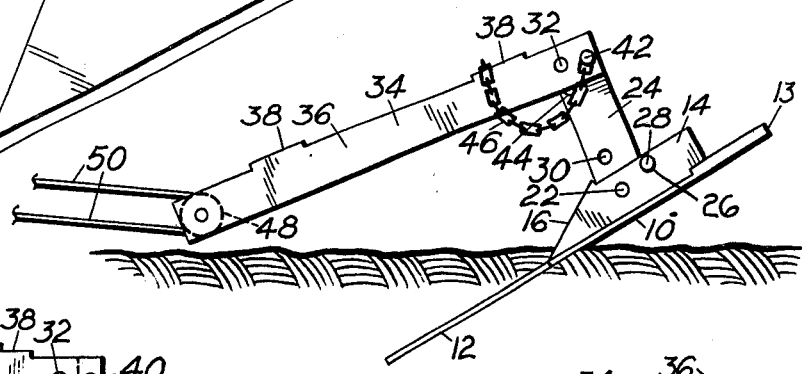
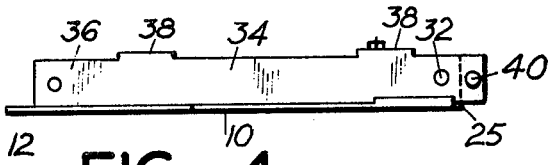
FIG. 4
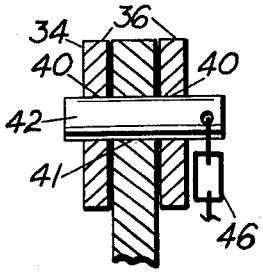
FIG. 5
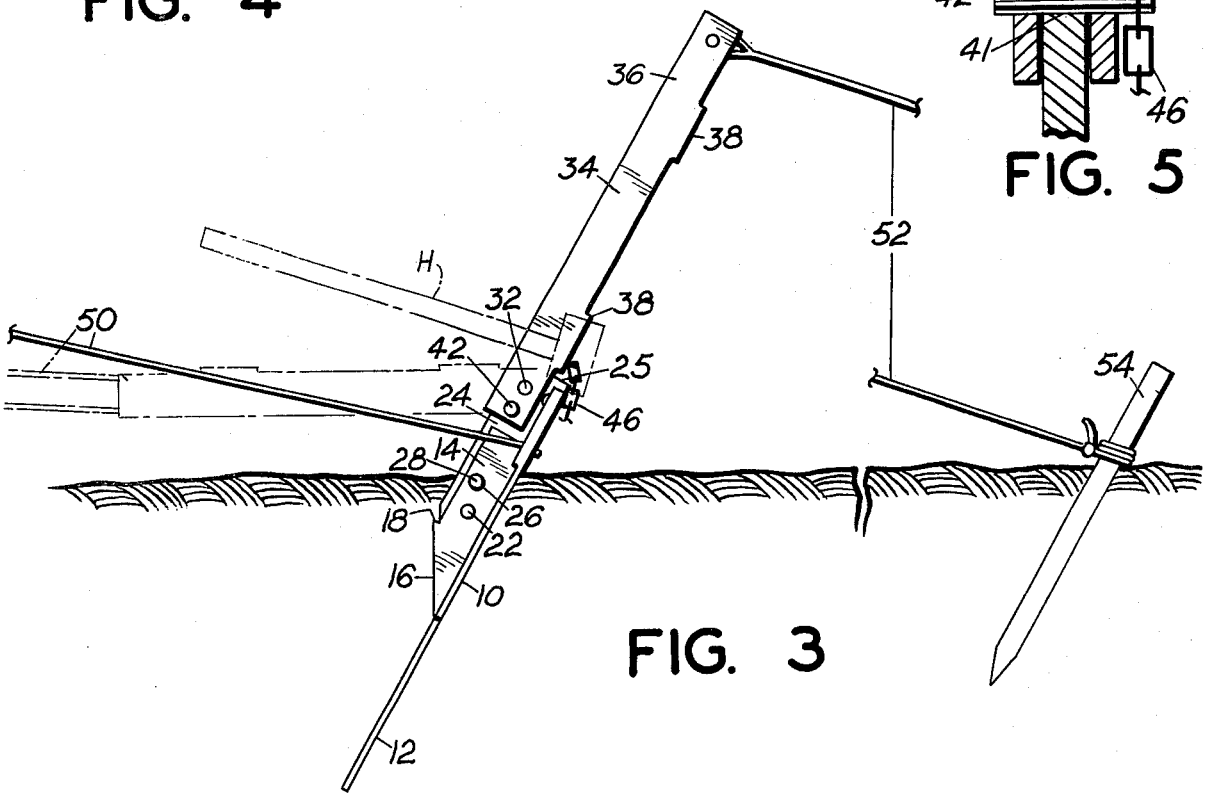
FIG. 3

GROUND ANCHOR

BACKGROUND OF THE INVENTION

This invention relates to new and useful improvements in ground anchors.

Anchors are frequently needed on land such as for use with recreation vehicles having winch means thereon. That is, this type of vehicle is often driven off the main roads and may become stuck, and where a tree or the like is not available as a stationary pulling point, the only possibility for using the winch to pull the vehicle out is with an anchor. Anchors for this purpose must be adaptable for use with various types of ground conditions, such as soft ground, hard ground, rocky ground, etc. Also, it is desirable that an anchor of this type take up a minimum of space while being stored since for the most time they will not be in use.

SUMMARY OF THE INVENTION

According to the present invention and forming a primary objective thereof, a ground anchor is provided having a structural arrangement making it extremely versatile for use in substantially all ground conditions.

A more particular object of the invention is to provide an anchor of the type described having a single blade or fluke and also having a first shank portion pivotally attached to the blade and a second shank portion pivotally attached to the first shank portion, and including a pivotal arrangement and stop means such that the shank portions can be selectively positioned relative to each other and relative to the blade to shape the anchor for adaption to various ground conditions.

Another object of the invention is to provide an anchor of the type described which is foldable to a compact storage condition.

The invention will be better understood and additional objects and advantages will become apparent from the following description taken in connection with the accompanying drawings.

BRIEF DESCRIPTION OF THE DRAWINGS

FIG. 1 is a perspective view of the present anchor showing one adjusted shape of the anchor;

FIG. 2 is a side elevational view of the anchor as shaped in FIG. 1 and showing the anchor penetrating the ground;

FIG. 3 is a side elevational view showing in full and phantom lines two other adjusted shapes of the anchor as penetrating the ground;

FIG. 4 is a side elevational view in reduced scale of the anchor as folded into a compact unit; and FIG. 5 is an enlarged sectional view taken on the line 5—5 of FIG. 1.

DETAILED DESCRIPTION OF A PREFERRED EMBODIMENT

The anchor comprises a single blade or fluke 10 having a pointed bottom ground engaging portion 12 at one end and a rear edge portion 13 at the other end. The blade 10 has a pair of parallel integral flange extensions 14 extending up from the face thereof at substantially right angles. These flange extensions terminate short of the pointed end of the anchor, and the front end of the flanges have inclined portions interconnected by a wall or web portion 16 having a rear edge 18 disposed at about the top of the incline. The area between the flanges 14 is open at the top behind edge 18, at the bottom, and at the back, a slot 20 leading centrally inwardly from the rear edge of the blade and terminating at a point approximately below edge 18.

Pivotally attached between the two flanges 14 by a pivot pin 22 which leads transversely and substantially parallel to the plane of the front face of the blade is a first shank portion 24. The free end of first shank portion 24 terminates in a substantially right angle edge 25. A pair of transversely aligned apertures 26 are provided in the flanges 14 rearwardly of the pivot 22, and these apertures are arranged to removably receive a stop pin 28. Apertures 26 are selectively located such that when the first shank portion 24 is pivoted to about a right angle position relative to the face of blade 10, as shown in FIGS. 1 and 2, the pin 28 when inserted therein will confine said first shank portion between it and the stop edge 18. Shank portion 24 has a transverse aperture 30 a short distance above its pivot, and this aperture is located at the same radial distance from pivot point 22 as are apertures 26 so that with the pin 28 removed from apertures 26, the shank portion 24 can be pivoted rearwardly to a position parallel with the blade and locked in such positon by insertion of the pin 28 through apertures 26 and 30. This position is shown in FIG. 3.

Pivotally attached to the free end of first shank portion 24 by a pivot pin 32 is a second shank portion 34 comprising a pair of parallel plate-like arms 36 secured together by a pair of spaced webs 38 on their upper edge, the area at the bottom between the arms 36 being open.

Webs 38 are disposed inwardly from the respective ends. The second shank portion 34 has transversely aligned apertures 40, FIGS. 1, 4 and 5, rearwardly of the pivot 32, and first shank portion 24 has a transverse aperture 41, FIG. 5, arranged for alignment with apertures 40 when the second shank portion 34 is disposed at about right angles to the first shank portion 24 and leading in the same direction as the point of the blade. Such a position is shown in FIGS. 1 and 2. A lock pin 42 is arranged to be received in apertures 40 and 41, and with such lock pin in place the shank portion 34 is arranged to be securely held at about said right angle position to the shank portion 24 or in other words it will be held substantially parallel, or possibly in slight diverging relation, with the front face of the blade 10.

Pivot point 32 is disposed closer to the end 25 of the first shank portion than it is to the rear edge of said shank portion so that, for a reason to be more apparent hereinafter, the rearward end of the second shank portion 34 will project beyond the end 25 when the anchor is shaped so that the shank portion 24 is laid down parallel with the blade 10 and the shank portion 34 extends forwardly either parallel with the blade or angled acutely up therefrom. FIG. 4 shows this relationship of the parts in the laid down position of the shank portion 24.

First shank portion 24 has an aperture 44 located in a plane below pivot 32, and such aperture is the same radial distance from the pivot point 32 as the aperture 41 and arranged such that upon removal of lock pin 42 from apertures 40 and 41, the second shank portion can be pivoted to a straight line position relative to the first shank portion and held in such straight-line position by insertion of the pin 42 in apertures 40 and 44. Pins 28 and 42 preferably have retaining chains 46 attached thereto to prevent loss.

The outer or free end of second shank portion 34 has a pulley 48 supported thereon, such pulley being disposed between the arms 36 and arranged to receive a line passed upwardly between the arms behind the pulley.

The anchor may be folded to a compact position as shown in FIG. 4 by removal of the pins 28 and 42 and rotating the first shank portion 24 backward to a position such that its rearward edge is about parallel with the blade 10. Then the second shank portion 34 is rotated in the opposite or forward direction until its bottom edge at the front lays down on the blade. The open bottom structure of the second shank portion 34 allows it to overlap the flange extensions 14 in this folded position to form a compact unit for shipment or storage.

For using the anchor in most types of terrain, it is shaped as shown in FIGS. 1 and 2 wherein the first shank portion 24 is positioned upright at a right angle relative to the blade 10 and the second shank portion 34 is positioned at right angles to the first shank portion with its free end extending in the same direction as the point of the blade. In this shape of the anchor, the first shank portion 24 is held in its position by confinement between edge 18 and pin 28 the latter being engaged in apertures 26, and the second shank portion 34 is held in its position by pin 42 engaged in apertures 40 and 41. A line 50 is passed over pulley 48, and when pulled straight ahead by the vehicle winch, the point of the anchor automatically digs in the ground. If necessary, the anchor may first be started with a few taps of a hammer or the like on the rear edge 13.

As seen in FIG. 3, the second shank portion 34 can be pivoted to a position extending straight out rearward from the blade 10 and parallel therewith to form an elongated stake. In this shape of the anchor, the first shank portion 24 is locked in its position parallel with the blade by engagement of pin 28 in apertures 26 and 30 and the second shank portion 34 is held out straight by engagement of pin 42 in apertures 40 and 44. When the anchor is used in this latter form, the point of the anchor is first driven into the ground as by a hammer H or the like and an anchor line 52 tied between the pulley 48 and a rearwardly placed peg 54 pounded into the ground. In this use of the anchor, the line 50 to the vehicle can be attached any place to the anchor but preferably at a low level. The anchor when shaped as shown in full lines in FIG. 3 is particularly useful in rocky ground or other places where it is extremely difficult to set an anchor and such must be done by pounding it in manually.

The anchor is capable of assuming still another shape, namely, a shape as shown in phantom lines in FIG. 3 and one that is useful for setting the anchor in medium hard ground. In this arrangement, the first shank portion 24 is held in a position parallel with the blade 10 the same as in the anchor shape just described, namely by pin 28 engagement of apertures 26 and 30. The second shank portion 34, however, is rotated to a position assuming an acute angle with the blade 10 and in this position of the said second shank portion and in view of the closer spacing of the pivot point 32 to the top edge 25 of first shank portion 24 than to the rear edge of the latter, the pin 42 can be inserted into apertures 40 behind the said edge 25. With the pin 42 thus inserted in the apertures 40 the second shank portion 34 is limited in its angular movement away from the blade, namely, to about the position shown in FIG. 3, by engagement of pin 42 with end edge 25. In this shape of the anchor, it is usually necessary that it be started into the ground with a hammer or the like, or if desired a bar may be inserted into the anchor arm just behind the rear web 38 so that a helper may stabilize the anchor when a pull is exerted thereon.

The three possible shapes of the anchor will function in substantially any type of soil, thus making the anchor versatile in its use for substantially any type of function.

It is to be understood that the form of my invention herein shown and described is to be taken as a preferred example of the same and that various changes in the shape, size and arrangement of parts may be resorted to without departing from the spirit of my invention, or the scope of the subjoined claims.

Having thus described my invention, I claim:

1. A ground anchor comprising a. a blade having upper and lower surfaces and a sharpened front end arranged to penetrate the ground, b. a first shank portion, c. first pivot means connecting said first shank portion at one of its ends to said blade, d. the axis of said first pivot means extending in a direction transversely of said blade, e. a second shank portion, f. second pivot means connecting one end of said second shank portion to the end of said first shank portion which is opposite from the pivot connection with said blade, g. the axis of said second pivot means also extending in a direction transversely of said blade, h. and releasable connectiong means engageable between said blade and said first shank portion and between said first and second shank portions, i. said releasable connecting means in a first operative position including means rigidly locking said first and second shank portions in longitudinal alignment with each other and in longitudinal alignment with said blade to form a longitudinal extension of said blade in a stake-like structure, j. said releasable connecting means in a second operative position including means rigidly locking said first shank portion parallel with and along said blade but allowing pivotal movement of said second shank portion a selected amount away from said blade but less than 90° therefrom, k. said releasable connecting means in a third operative position including means rigidly locking said first shank portion at substantially a right angle relative to said blade and rigidly locking said second shank portion at substantially a right angle relative to said first shank portion extending substantially parallel with said blade and in the same direction as the sharpened end of the latter.

2. The ground anchor of claim 1 wherein said blade includes a pair of upwardly extending longitudinal flanges between which said first shank portion is pivotally connected, and including a web extending integrally across said flanges, said web serving as a stop for said first shank portion in its right angle position relative to said blade.

3. The ground anchor of claim 1 wherein said releasable connecting means have an inoperative position allowing pivotal movement of said first shank portion to a position parallel with and along said blade and allowing pivotal movement of said second shank portion to a position parallel with and also along said blade to provide a compact folded unit.

* * * * *